US007891593B2

(12) United States Patent
Gronholz

(10) Patent No.: US 7,891,593 B2
(45) Date of Patent: Feb. 22, 2011

(54) DEVICE FOR COMMINUTING A HEAP OF PARTICULATE MATERIAL

(75) Inventor: Claus Gronholz, Norderstedt (DE)

(73) Assignee: GET Hamburg GmbH, Hamburg (DE)

( * ) Notice: Subject to any disclaimer, the term of this patent is extended or adjusted under 35 U.S.C. 154(b) by 491 days.

(21) Appl. No.: 12/056,019

(22) Filed: Mar. 26, 2008

(65) Prior Publication Data

US 2008/0251618 A1 Oct. 16, 2008

Related U.S. Application Data

(63) Continuation of application No. PCT/EP2006/009429, filed on Sep. 28, 2006.

(51) Int. Cl.
*B02C 13/00* (2006.01)

(52) U.S. Cl. ..... 241/188.1; 241/193; 241/285.1

(58) Field of Classification Search ..... 241/188.1, 241/193, 285.1, 285.2
See application file for complete search history.

(56) References Cited

U.S. PATENT DOCUMENTS

| | | | | | |
|---|---|---|---|---|---|
| 3,622,088 | A * | 11/1971 | Gunkel | 241/44 |
| 4,637,561 | A * | 1/1987 | Edberg | 241/154 |
| 4,641,792 | A * | 2/1987 | Villavicencio et al. | 241/74 |
| 4,747,550 | A * | 5/1988 | Jackering | 241/55 |
| 4,844,365 | A * | 7/1989 | Rossouw et al. | 241/275 |
| 4,886,216 | A * | 12/1989 | Goble | 241/152.1 |
| 5,192,029 | A * | 3/1993 | Harris | 241/27 |
| 5,205,500 | A * | 4/1993 | Eide | 241/154 |
| 5,967,432 | A * | 10/1999 | Chen | 241/38 |
| 6,325,306 | B1 * | 12/2001 | Gacanich et al. | 241/15 |
| 2006/0124787 | A1 * | 6/2006 | Schweiger et al. | 241/89.3 |

FOREIGN PATENT DOCUMENTS

| | | | |
|---|---|---|---|
| DE | 195 20 325 | A1 | 7/1995 |
| GB | 2 130 917 | A | 6/1984 |
| GB | 2130917 | A | 6/1984 |
| JP | 56056239 | | 5/1981 |
| JP | 2002204967 | | 7/2002 |
| JP | 2004016972 | | 1/2004 |
| WO | 9218248 | | 10/1992 |
| WO | 2004024331 | | 3/2004 |

* cited by examiner

*Primary Examiner*—Bena Miller
(74) *Attorney, Agent, or Firm*—Vidas, Arrett & Steinkraus

(57) ABSTRACT

Device for comminuting a heap of particulate material, comprising a framework-supported housing with a vertical axis which is provided at its upper end with at least one inlet opening for the heap and at its lower end with an outlet; a drive shaft which is arranged vertically and centrally in the housing and is driven by a drive motor; and a rotor which is mounted on the drive shaft and has a plurality of rotor elements which are offset in the circumferential direction and/or with an axial spacing and which extend, at least while the rotor is rotating, close to the actual housing wall in order to process the downwardly falling heap, wherein the housing has at least two housing sections arranged vertically above one another, of which the lower section, at least in the upper region adjoining the section above it, has a larger diameter than the adjoining region of the upper housing section, and the radial extent of the rotor elements in the upper region of the lower housing section is larger than the diameter of the lower region of the housing section situated above it.

28 Claims, 3 Drawing Sheets

DEVICE FOR COMMINUTING A HEAP OF PARTICULATE MATERIAL

CROSS-REFERENCE TO RELATED APPLICATIONS

Not applicable.

STATEMENT REGARDING FEDERALLY SPONSORED RESEARCH

Not applicable.

BACKGROUND OF THE INVENTION

DE 202 15 158 U1, the entire contents of which is incorporated herein by reference, discloses a device for comminuting and mixing bulk material. With the known device a cylindrical housing is uprightly arranged having an upper feeding end and a lower disposal end. A drive shaft with a plurality of rotor elements which are offset in the circumferential direction and/or with an axial spacing is centrally arranged in the housing. In one embodiment the rotor elements are formed of chains extending close to the housing wall when the rotor is set in rotation. The bulk commodity to be processed falls nearly in free fall through the housing and is thereby being comminuted and homogenized appropriately. Therefore, it is possible to achieve a high throughput with simple means.

The material to be comminuted is thrown radially outwards against the housing wall and brought to a substantial circumferential speed at the same time during the processing. There is the danger of the material sticking to the housing wall, especially if it possesses a certain adhesion capacity. The efficient comminuting is thereby hindered and the throughput is reduced.

BRIEF SUMMARY OF THE INVENTION

The housing according to the present invention has at least two housing sections arranged vertically above one another, of which the lower section, at least in the upper region adjoining the section above it, has a larger diameter than the adjoining region of the upper housing section. The radial extent of the rotor elements in the upper region of the lower housing section is larger than the diameter of the lower region of the housing section situated above it.

According to another embodiment of the invention this can be practically solved by a housing wall being formed sawtooth-like in cross-section, whereas each housing section is a cone with a diameter decreasing from the top down. Alternatively, it can be provided for cylindrical housing sections telescopically mating and the diameter of each housing section increasing from the top down.

The device according to the invention has cascades lying upon each other being formed either as cylindrical steps or shaped like truncated cones, each lower truncated cone being larger in its upper diameter than the truncated cone lying above in its smaller diameter. By this it is ensured that the material located at a housing section and moving downwards hits the rotating elements that rotate beneath again, thus being further comminuted. By means of a given number of housing sections or cascades being vertically arranged above each other a most efficient and homogenous comminuting of the debris can thus be achieved. The debris can be soil material for example, like sludge of chalkstone or the material can be domestic waste that is to be sufficiently and evenly comminuted for dumping or incinerating or the like.

According to one embodiment of the invention the housing comprising the several housing sections can be mounted to be vertically movable and adjusted vertically by an adjusting device, for example by means of multiple circumferentially spaced air bellows. That way a cleaning-effect is gained.

According to another embodiment of the invention, brake elements decelerating the circumferential velocity of the material in the area of the inner housing wall can be arranged in circumferential interspaces beneath at least one radial plane of rotating elements. The braking elements are preferably of a flexible material and are adapted for deflecting the material downwards via an inclined plane. By reducing the circumferential velocity of the material a sufficient relative speed is achieved between the rotating elements and the material, thus enhancing the comminuting effect.

According to another embodiment of the invention the housing or its interior wall can be of a yielding material. This reduces the adherence of material. Such a reduction can also be achieved by assigning a vibration device to the housing.

Depending on the condition of the debris, it may be advantageous heating it during it's passage through the device. Hence, according to one embodiment of the invention a heating unit is assigned to the housing.

In order to prevent contamination of the environment it can be advantageous with certain materials if the interior of the housing is sealed off or according to another embodiment of the invention a low or high pressure is generated. Furthermore, injectors for sprinkling water for example into the interior can be arranged at the housing wall to moisten the material and to reduce formation of dust.

As in the known case, the rotating elements can be formed of chains being arranged at the rotor in circumferential sections. Alternatively, rod-shaped rigid rotating elements can be provided for being hinged at the rotor.

According to another embodiment of the invention a housing cover with separate inlets can be provided for. That way, different components can be filled into the device according to the invention being not only comminuted but also intermixed.

The drive of the shaft can be located above the housing the shaft extending down into the housing. Alternatively, an upright shaft with a driving motor beneath the housing can be provided for. In this case, a circular outlet out of the housing can be provided for surrounding the driving motor or the shaft respectively. The circular outlet itself can be provided with multiple outlets being arranged in circumferential spacings for apportioning the material. Alternatively, further devices according to the invention can be arranged underneath for further comminuting and homogenizing the material.

Another embodiment of the invention provides for two coaxial shafts extending into the housing that can be driven independently, preferably with opposite rotational direction or different rotational speed. Thus, the efficiency of the comminuting is yet increased. The shafts can also be arranged concentrically by forming an outer shaft as a hollow shaft and arranging an inner shaft inside the hollow shaft.

BRIEF DESCRIPTION OF THE SEVERAL VIEWS OF THE DRAWINGS

The invention will be explained with respect to figures illustrating embodiments in more detail below.

DETAILED DESCRIPTION OF THE INVENTION

Figure 1:
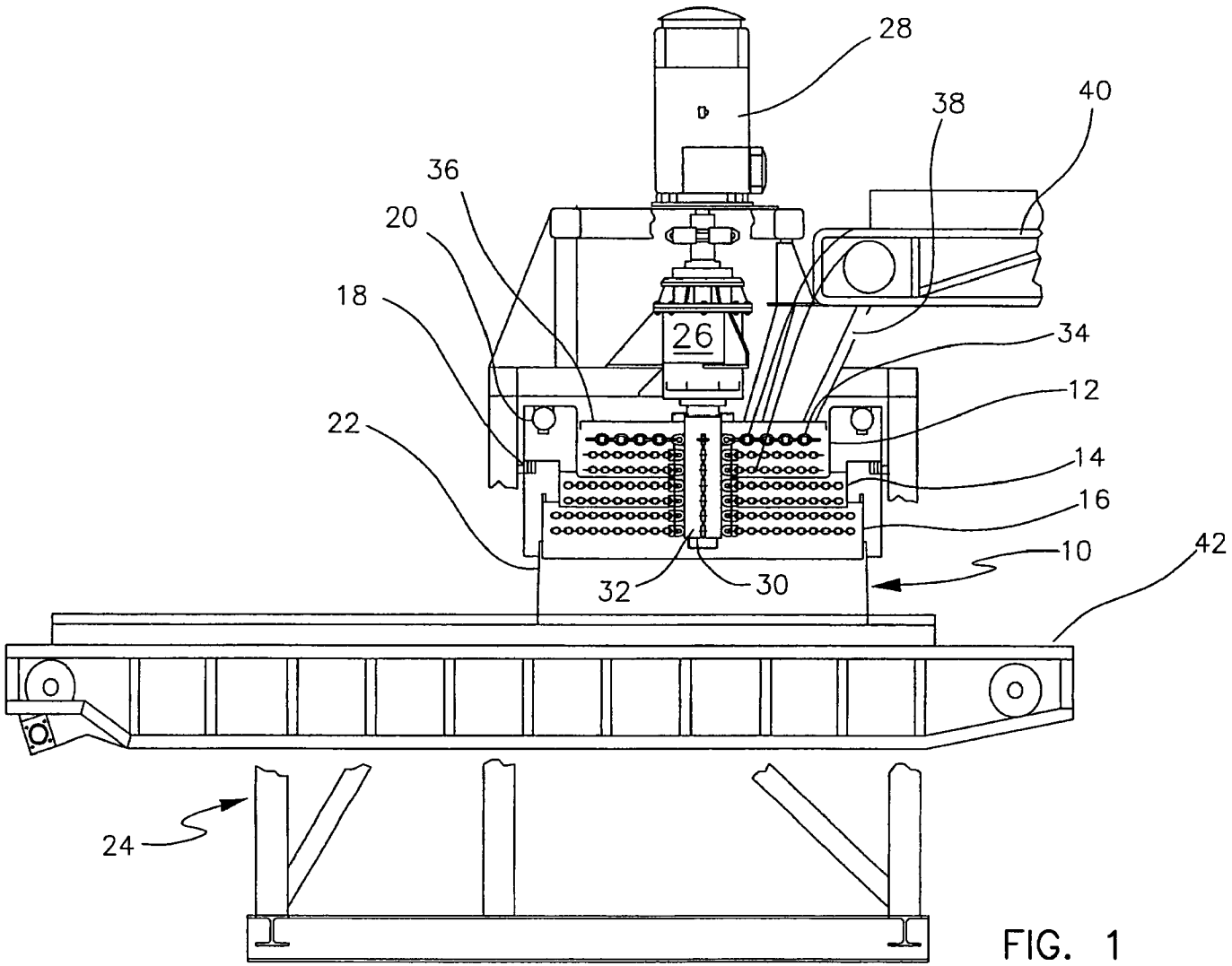
FIG. 1 is a sectional view of an embodiment of the device according to the invention.

While this invention may be embodied in many different forms, there are described in detail herein a specific preferred embodiment of the invention. This description is an exemplification of the principles of the invention and is not intended to limit the invention to the particular embodiment illustrated FIG. 1 shows a housing 10 comprising 3 cylindrical housing sections 12, 14, 16 being telescopically arranged into one another. The housing sections 12 to 16 increase in diameter from the bottom up. Springs 18 engage with a radial flange of the central housing section 14 from below, the interconnected housing sections 12, 14, 16 can be vertically adjusted by said springs. A vibration device 20 engages a radially protruding flange of the upper housing section 12 at the lower side. With that, the entire housing 10 can be set into vibration. The lower housing section 16 is connected to a cylindrical skirt 22 of a flexible material.

The housing 10 is suspended in a frame 24. The frame supports the shaft 30 in the upper area 26 the shaft being driven by an electric motor 28. A torque proof cylindrical sheath 32 is attached to the shaft 30. Multiple levels of chains 34 are attached to the sheath. Multiple circumferentially spaced chains 34 are provided for in each level. The chains extend horizontally only at sufficient rotational speed of the shaft 30 as shown. A cover 36 of the housing 10 has a filling funnel 38 through which material can be filled in axially parallel from above via a conveying device 40.

As can be seen, a chain arrangement of three levels being situated above each other is provided for in the upper housing section 12, whereas the outer diameter approximates the internal diameter of the wall of the housing section 12. The housing diameter of section 14 is larger compared to that of the housing section 12. The chains in the two levels being situated above each other are of a larger diameter, accordingly. Eventually, the chains 34 in the housing section 16 are again radially longer than the chains in the housing section 14.

The material being filled in from above and nearly falling in free fall is being comminuted by the rotating chains and catapulted against the housing wall there being moved with a substantial rotational speed. It also moves downwards at the same time. That way, the material being moved at the housing wall of the upper housing section hits the chains of the middle housing section and is again effectively comminuted. The same happens inside housing section 16.

The comminuted material arrives at a horizontal conveyor device 42.

In order to prevent adhesion of the material to the wall of the housing sections 12 to 16 a vibration can constantly be transferred to the housing 10 by means of the vibration device.

Figure 4:
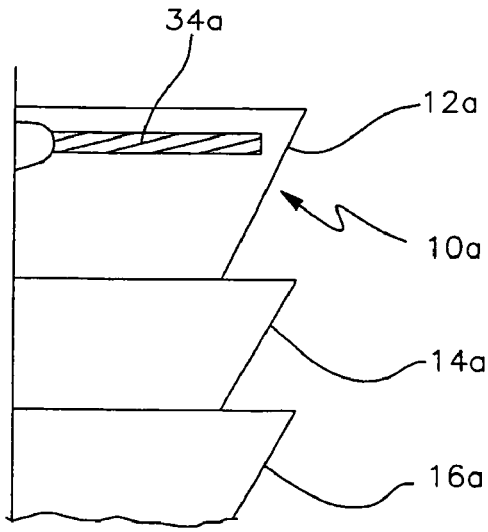
FIG. 4 shows most schematically a modified embodiment of the device according to the invention.

FIG. 4 indicates an alternative embodiment of a housing for the device according to the invention. Instead of mating cylindrical housing sections provision is made for conical housing sections 12*a*, 14*a* and 16*a* each narrowing top down. A step is thus formed between each housing sections 12*a* to 16*a*. A rotating element e.g. a chain is indicated at 34*a*. It can be seen, that it's radial extension is larger than the diameter of the lower area of the above housing section. That way, the material consistently hits a chain and can be comminuted effectively as in case of the device according to FIG. 1.

Figure 5:
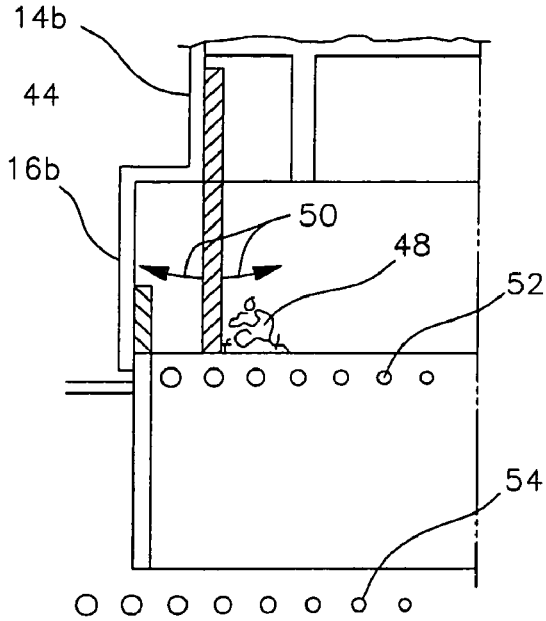
FIG. 5 shows a further embodiment of the device according to the invention.

Two cylindrical housing sections 14*b*, 16*b* can be seen in FIG. 5 being arranged similarly as in FIG. 1. The specific feature in FIG. 5 is that a cylindrical section of a flexible material extending into the subjacent housing section 16*b* is attached to the interior wall of an upper housing section 14*b*. Material 48 being catapulted radially outwards when comminuted can thus cause a deflection of section 44 as indicated by arrows 50. The subjacent rotating elements 52 and 54 respectively increase in diameter in order to effectively comminute the falling off material.

Figure 6:
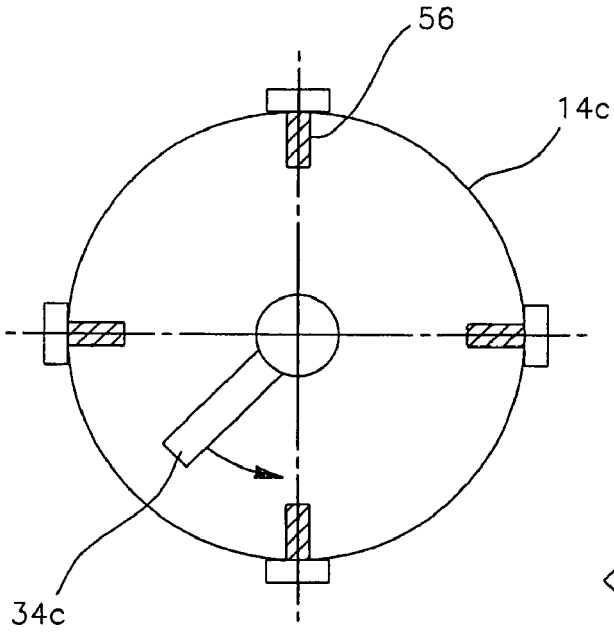
FIG. 6 schematically shows a cut through a device according to the invention.
Figure 7:
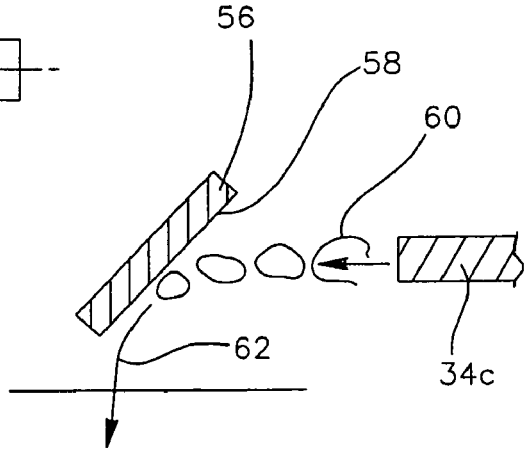
FIG. 7 shows a side view of a brake element of the device according to FIG. 6.

In FIG. 6 is illustrated how brake elements 56 being arranged below and above a level of rotating elements are mounted at 90° intervals on a housing section 14*c* one of which being shown by 34*c*. Furthermore, it can have an inclined plane 58 as shown in FIG. 7 for deflecting down material 60 being catapulted outwards by rotating elements 34*c* as indicated by arrow 62. The brake elements 56 decrease the rotational speed of the material 56 and thereby allow for a higher relative speed between the rotating elements and the material.

FIG. 2 again indicates the device for comminuting a heap of particulate material as it is shown in FIG. 1. Hence, equal parts are provided with equal reference signs.

Figure 3:
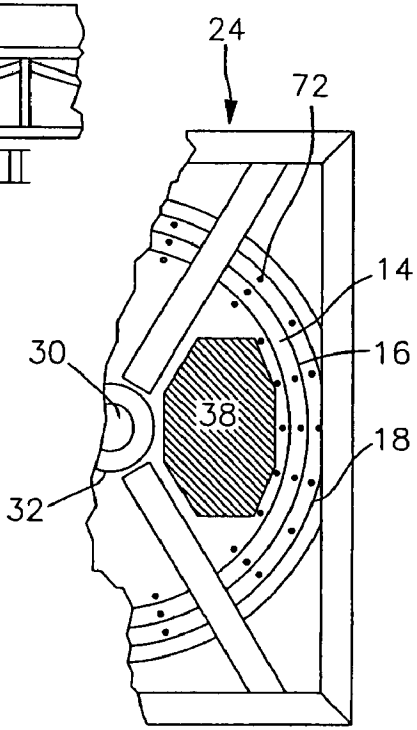
FIG. 3 shows a cut through the illustration according to FIG. 2 along the line 3-3.
Figure 2:
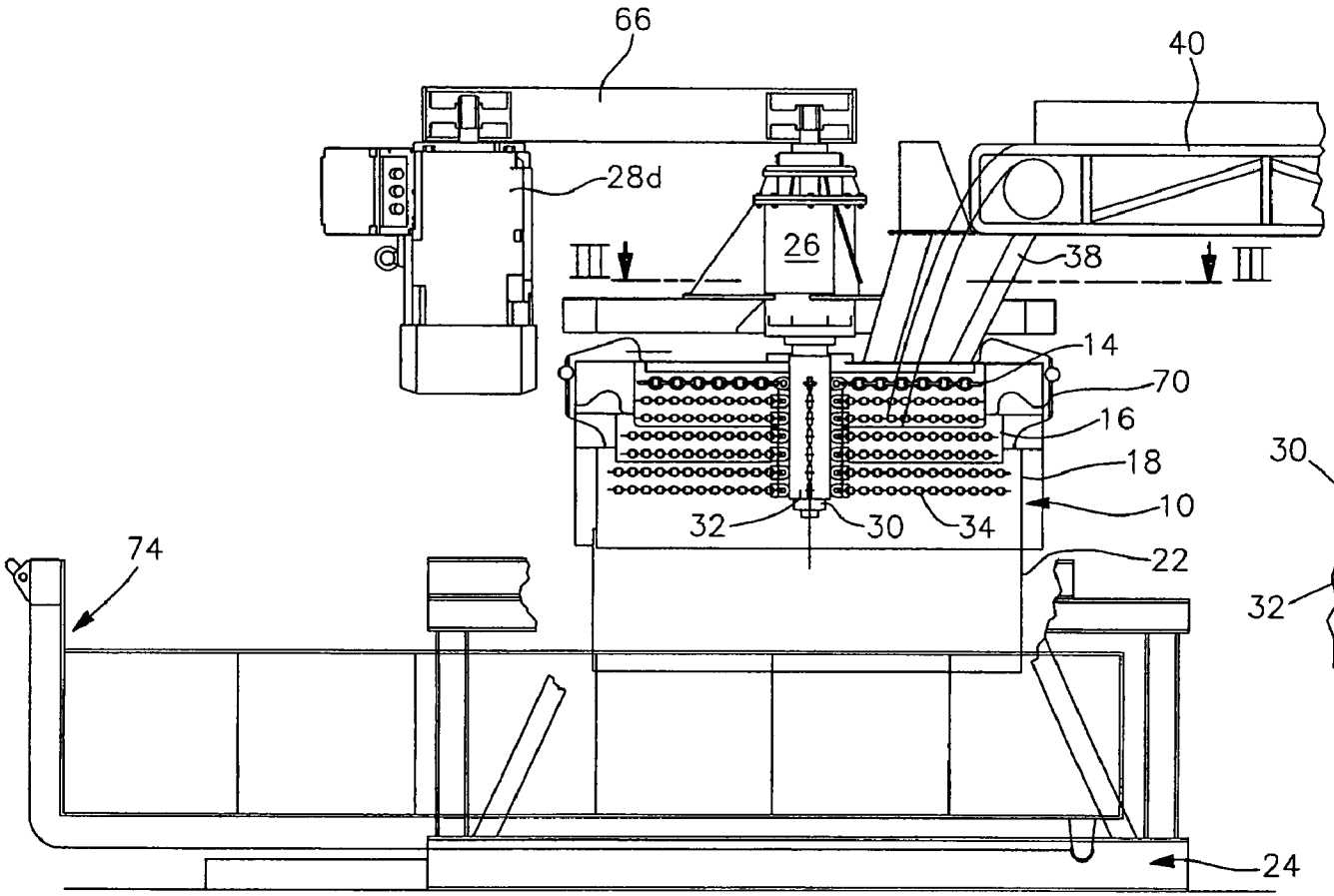
FIG. 2 is a sectional view of an arrangement similar to the device according to FIG. 1.

Unlike FIG. 1 a driving motor 28*d* is arranged outside of the driving shaft and connected with the shaft 30 via a belt drive 66. The shaft 30 has a mount 26. The specific feature in FIG. 2 is that injectors each being present in the steps between the housing sections 14 to 18 are supplied with water via conduits 70, via said injectors water for example is induced tangential to the interior wall of the housing sections to cause flaking of material from the interior wall. In FIG. 3 can be seen that provision is made for a plurality of injectors 72 in circumferential direction.

In FIG. 2 can be seen that a container 74 is located beneath the discharge skirt 22 of the comminuting device.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Device for comminuting a heap of particulate material, comprising a framework-supported housing with a vertical axis which is provided at its upper end with at least one inlet opening for the heap and at its lower end with an outlet; a drive shaft which is arranged vertically and centrally in the housing and is driven by a drive motor; and a rotor which is mounted on the drive shaft and has a plurality of rotor elements which are offset in the circumferential direction and/or with an axial spacing and which extend, at least while the rotor is rotating, close to the actual housing wall in order to process the downwardly falling heap, wherein the housing (10, 10*a*) has at least two housing sections (12 to 16, 12*a* to 16*a*, 14*b*, 16*b*) arranged vertically above one another, of which the lower section, at least in the upper region adjoining the section above it, has a larger diameter than the adjoining region of the upper housing section, and the radial extent of the rotor elements (34, 34*a*, 52, 54) in the upper region of the lower housing section is larger than the diameter of the lower region of the housing section situated above it, and that one shaft respectively is assigned to a housing section or an associated group of housing sections, the shafts coaxially lying to each other and being independently drivable.

2. Device according to claim 1, characterized in that one shaft is formed as a hollow shaft embedding the other shaft.

3. Device according to claim 1, characterized in that the housing wall is formed sawtooth-like in cross-section, whereas each housing section (12*a* to 16*a*) is a cone with a diameter decreasing from the top down.

4. Device according to claim 1, characterized in that cylindrical housing sections (12 to 16) telescopically mate, whereas the diameter of each housing section increases from the top down.

5. Device according to claim 1, characterized in that the housing sections are firmly connected to each other.

6. Device according to claim 1, characterized in that the housing (10, 10*a*) is mounted vertically movable and vertically adjustable by an adjusting device.

7. Device according to claim 6, characterized in that the adjusting device has multiple circumferentially spaced air bellows (18).

8. Device according to claim 1, characterized in that brake elements (56) decelerating the circumferential velocity of the material in the area of the inner housing wall are arranged in circumferential interspaces beneath at least one radial plane of rotating elements (34).

9. Device according to claim 8, characterized in that the braking elements (56) are of a flexible material.

10. Device according to claim 8, characterized in that the braking elements (56) have an inclined plane (58) for deflecting material impacting in radial and/or circumferential direction downwards.

11. Device according to claim 1, characterized in that the housing (10, 10*a*) or its interior wall respectively is made of a yielding material.

12. Device according to claim 1, characterized in that a vibration device (20) is assigned to the housing (10).

13. Device according to claim 1, characterized in that the housing has a heating unit.

14. Device according to claim 1, characterized in that the interior of the housing is sealed off.

15. Device according to claim 1, characterized in that a low or high pressure is generated inside the housing (10, 10*a*).

16. Device according to claim 1, characterized in that injectors (72) being connected to a source for fluids under pressure are arranged at the housing wall.

17. Device according to claim 1, characterized in that the driving shaft (30) is mounted in a suspended arrangement and extends into the housing, the rotor having a sheath (32) being detachably but non-twistably attached to the shaft (30).

18. Device according to claim 1, characterized in that the rotating elements (34) are formed of chains.

19. Device according to claim 18, characterized in that multiple circumferentially spaced chains in each level and multiple axially spaced levels of chains are provided for.

20. Device according to claim 1, characterized in that one level of rotating elements each lies closely beneath the overlying housing section (12 to 16 and 12*a* to 16*a* respectively).

21. Device according to claim 1, characterized in that the rotating elements are arranged in a way that they basically do not generate unbalances.

22. Device according to claim 1, characterized in that the housing (10, 10*a*) is open at the bottom.

23. Device according to claim 22, characterized in that the outlet is formed by a cylindrical flexible skirt (22).

24. Device according to claim 1, characterized in that the driving motor is arranged beneath the housing and drives a shaft extending upwards into the housing.

25. Device according to claim 24, characterized in that a ring-shaped outlet is provided for.

26. Device according to claim 1, characterized in that a cover of the housing provides two or more inlet openings.

27. Device according to claim 1, characterized in that the rotating elements in the first housing section lie in a first layer seen from above or altogether have a greater distance to the housing wall than the rotating elements underneath.

28. Device according to claim 4, characterized in that a cylindrical flexible wall section (44) is attached to a housing section (14*b*) and extends into the subjacent housing section (16*b*) with a larger diameter.

* * * * *